US009943747B2

(12) United States Patent
Erb et al.

(10) Patent No.: US 9,943,747 B2
(45) Date of Patent: Apr. 17, 2018

(54) LINER ASSEMBLY FOR A PROTECTIVE HELMET

(71) Applicant: Kranos IP Corporation, Litchfield, IL (US)

(72) Inventors: Robert Erb, Plandome, NY (US); Cortney Warmouth, Edwardsville, IL (US); Vincent R. Long, St. Peters, MO (US); Louis Anthony Vanhoutin, Luka, IL (US); Ray Drake, Salem, IL (US)

(73) Assignee: Kranos IP Corporation, Litchfield, IL (US)

( * ) Notice: Subject to any disclaimer, the term of this patent is extended or adjusted under 35 U.S.C. 154(b) by 126 days.

(21) Appl. No.: 15/079,693

(22) Filed: Mar. 24, 2016

(65) Prior Publication Data

US 2016/0199721 A1 Jul. 14, 2016

Related U.S. Application Data

(62) Division of application No. 13/874,885, filed on May 1, 2013, now Pat. No. 9,566,497.

(51) Int. Cl.

| | |
|---|---|
| ***A42B 1/06*** | (2006.01) |
| ***A42B 3/00*** | (2006.01) |
| ***A63B 71/10*** | (2006.01) |
| ***A42B 3/12*** | (2006.01) |
| ***A42B 3/10*** | (2006.01) |
| *A63B 102/18* | (2015.01) |

(52) U.S. Cl.

CPC ..... *A63B 71/10* (2013.01); *A42B 3/10* (2013.01); *A42B 3/125* (2013.01); *A42B 3/127* (2013.01); *A63B 2102/18* (2015.10)

(58) Field of Classification Search

CPC .... A42B 3/00; A42B 3/06; A42B 3/10; A42B 3/12; A42B 3/121; A42B 3/122; A42B 3/125; A42B 3/127; A42B 3/16; A42B 3/18; A63B 71/10

USPC ..... 2/410, 411, 413, 414, 425, 909

See application file for complete search history.

(56) References Cited

U.S. PATENT DOCUMENTS

| | | | | |
|---|---|---|---|---|
| 3,086,899 A * | 4/1963 | Ingraham | ..... | B32B 27/00 105/422 |
| 3,866,243 A | 2/1975 | Morgan | | |
| 3,882,547 A * | 5/1975 | Morgan | ..... | A42B 3/121 2/414 |

(Continued)

*Primary Examiner* — Jameson Collier

(74) *Attorney, Agent, or Firm* — Notaro, Michalos & Zaccaria P.C.

(57) ABSTRACT

A liner assembly for a protective helmet has a wrap-around pad inside the helmet with plural circular cells spaced along a curved line, at least one additional cell at each end of the line and one additional cell located off the line. A crown pad removably engageable in a crown of the helmet and two L-shaped jaw pads removably engageable to jaw flaps of the helmet. Each cell includes an outer sheet welded around its perimeter to the perimeter of an inner sheet, each inner sheet engaging a player's head and defining one enclosure for each cell. Each cell containing a foam cushion and multiple spaced apart hollow protrusions contacting the inside of the helmet. Each protrusion has an open large diameter base near the cushion and flat smaller diameter peak engaging the helmet. Each protrusions also having a conical side wall tapering from base to peak.

16 Claims, 10 Drawing Sheets

(56) References Cited

U.S. PATENT DOCUMENTS

| | | | | | |
|---|---|---|---|---|---|
| 4,282,610 | A * | 8/1981 | Steigerwald | A42B 3/127 | 2/414 |
| 4,558,470 | A | 12/1985 | Mitchell et al. | | |
| 4,627,114 | A | 12/1986 | Mitchell et al. | | |
| 5,035,009 | A | 7/1991 | Wingo, Jr. et al. | | |
| 5,175,889 | A * | 1/1993 | Infusino | A42B 3/122 | 2/413 |
| 5,263,203 | A * | 11/1993 | Kraemer | A42B 3/122 | 2/413 |
| 5,518,802 | A * | 5/1996 | Colvin | B32B 3/12 | 428/166 |
| 5,974,593 | A | 11/1999 | McNabb | | |
| 6,178,560 | B1 * | 1/2001 | Halstead | A42B 3/122 | 2/413 |
| 6,219,850 | B1 * | 4/2001 | Halstead | A42B 3/06 | 2/414 |
| 7,673,351 | B2 * | 3/2010 | Copeland | A41D 31/005 | 2/425 |
| 2004/0025231 | A1 * | 2/2004 | Ide | A42B 3/08 | 2/425 |
| 2010/0299812 | A1 * | 12/2010 | Maddux | A41D 13/0156 | 2/414 |
| 2011/0131695 | A1 * | 6/2011 | Maddux | A42B 3/18 | 2/9 |
| 2012/0036620 | A1 * | 2/2012 | Harris | A42B 3/127 | 2/414 |
| 2013/0014313 | A1 * | 1/2013 | Erb | A42B 3/122 | 2/410 |
| 2013/0061375 | A1 * | 3/2013 | Bologna | A42B 3/127 | 2/414 |

* cited by examiner

FIG. 7
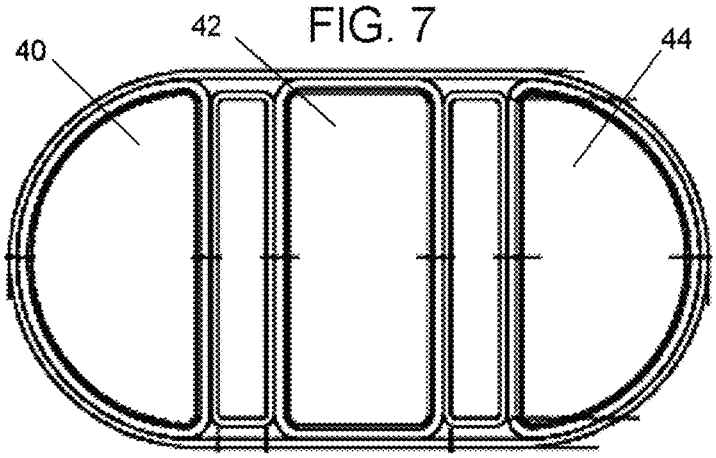
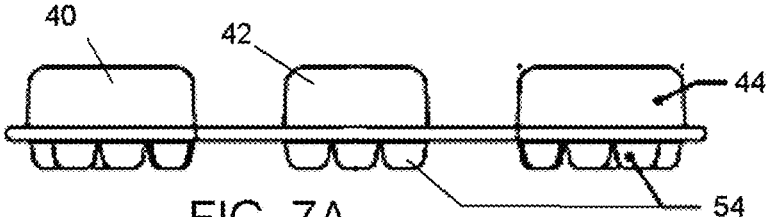
FIG. 7A
FIG. 8
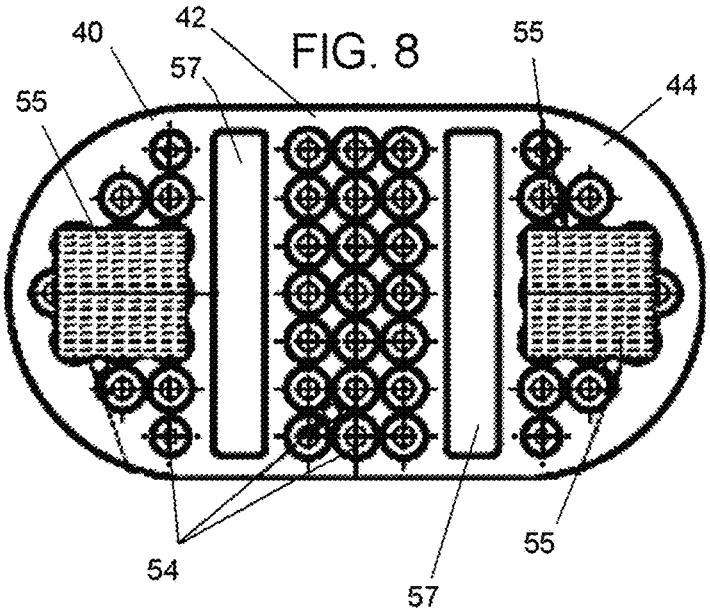

FIG. 12
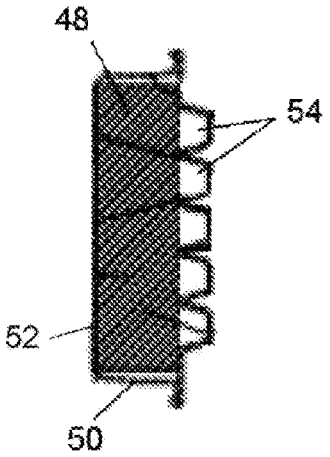
FIG. 13
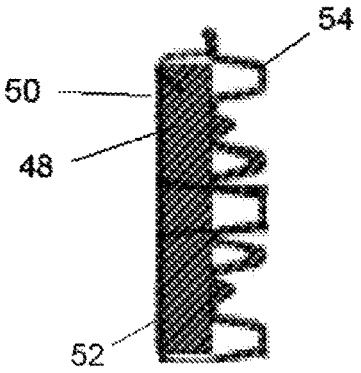
FIG. 14
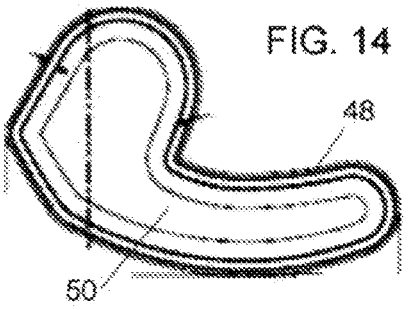
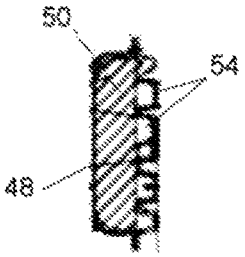
FIG. 14A
FIG. 15
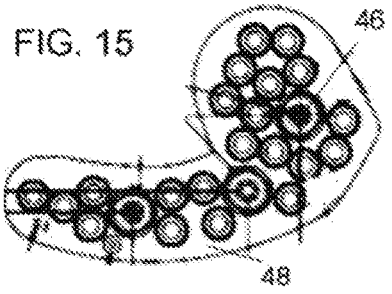

LINER ASSEMBLY FOR A PROTECTIVE HELMET

CROSS REFERENCE TO RELATED APPLICATION

This is a divisional of U.S. patent application Ser. No. 13/874,885 filed May 1, 2013 and incorporated herein by reference.

FIELD AND BACKGROUND OF THE INVENTION

The present invention relates generally to the field of protective helmets, and in particular to a new and useful liner assembly for a batting helmet for baseball and softball.

U.S. Pat. No. 5,974,593 to McNabb ("McNabb") teaches a batting helmet which includes a shell which has a crown portion, a right side, a left side, a front portion, a back portion, a forwardly-extending bill, and a pair of downwardly extending ear flaps. col. 2, II. 13-23. A series of pads are secured to the interior of the shell. The reference teaches that a crown pad that is secured to the apex of the crown portion. This crown pad includes a top hole extends through the crown portion of the shell to create a passageway for air circulation. The crown portion of the shell may also define additional holes for air circulation. An ear pad is secured to the interior of the shell at the lower end of each of the ear flaps. Both the crown pad and the ear pads are partially constructed of a low-density, spongy foam material. col. 2, II. 24-39.

U.S. Pat. No. 3,866,243 to Morgan ("Morgan") teaches a protective type headgear having a relatively hard outer shell construction. col. 1, II 2-4. Morgan teaches that the shell may take the form of a batting helmet, incorporating a protective ear flap. col. 3, II. 40-45. The focus of Morgan is a fitting means secured within the shell for engagement with the head of the wearer. col. 3, II. 8-10. Thus, the helmet of Morgan includes an inner liner formed of a foam plastic, this inner liner being engageable by the head of the wearer of the helmet. The liner defines an opening in the crown area of the helmet, and this opening is provided for receiving a downwardly extending compressible fluid reservoir 18. col. 3, II. 46-52.

U.S. Pat. No. 5,035,009 to Wingo, Jr. et al. ("Wingo") teaches a replaceable, removable liner for use in a protective helmet having an interior surface. Portions of the interior surface have pad structures disposed thereon in a spaced relationship, and other portions of the interior surface are exposed in the spaces between the pad structures. col. 2, II. 14-20. The liner of Wingo includes at least one sheet of material having a periphery surface which conforms to, and fits within, the spaces between the pad structures. col. 2, II. 21-24. Wingo teaches that the sheet of material may be a plastic material, which may be a plastic foam material. The plastic foam material may be a closed cell plastic foam material, which may be cross-linked polyethylene. col. 2, II. 34-39. The reference teaches that the sheet of material may have a plurality of raised projections on its upper surface, and these projections may be spaced from adjacent projections and separated therefrom by a portion of the at least one sheet of material having a reduced thickness. col. 2, II. 39-45.

U.S. Pat. No. 4,558,470 to Mitchell, et al. ("Mitchell"'470) teaches a protective apparatus in the form of headgear which includes an outer impact-receiving member or shell of substantially rigid material. Mitchell's system also includes a shock attenuation-system provided on the inside of the shell for attenuating the shock on the head resulting from an impact (or impacts) on the shell. col. 2, II. 22-26. The shock attenuation system of Mitchell comprises a plurality of separate pads constituting secured to the interior surface of the shell at positions corresponding to the front (forehead), back, sides and top of the head. Each pad contains a plurality of spaced-apart shock attenuating columns arrayed in a plurality of generally parallel rows (four rows of seven columns each as shown). The spacing between adjacent columns in a row is substantially equal, as is the spacing between adjacent rows of columns. Each column is hollow and tubular in shape and formed of a substantially resilient elastomeric material, such as vinyl, urethane, or polyethylene. col. 2, II. 38-51.

U.S. Pat. No. 4,627,114 to Mitchell ("Mitchell '114") teaches a helmet which includes an outer impact-receiving member or shell. A shock attenuation system is provided on the inside of the shell for attenuating the shock on the head resulting from an impact (or impacts) on the shell. The shock attenuation system comprises five separate shock attenuation modules or pads secured to the interior surface of the shell at positions corresponding to the front (forehead), back, left and right sides, and top of the head, respectively. The two pads at the sides of the helmet are generally rectangular in shape and curved to conform to the inside surface of the shell. They are located above the ear flaps of the helmet.

A need remains for further advancements in the field of batting helmet design, in particular for a batting helmet system which provides optimal protection for the head of the wearer without adding excess weight.

SUMMARY OF THE INVENTION

It is an object of the present invention to provide a batting helmet with helmet shell and, internal padding system, comfort liner, attachment arrangement and other improvements over currently known helmets.

Accordingly one of the various objects of the invention is to provide a batting helmet that provides significant protection without adding undue weight. This feature is particularly important in the youth sports setting. In this setting, the athletes are smaller and there is a heightened concern for participant safety.

Another object of the invention is to provide a helmet liner assembly which includes a wrap-around padding that effectively protects side of the wearer's head. The assembly also includes a pair of jaw pads which protect the wearer's face particularly the jaw region.

Protection of the front and side of the head as well as the of jaw region is of particular importance in baseball and softball as these are the sides of the wearer's head which face the pitcher when the wearer is batting.

The liner assembly also includes a crown pad engaged to a crown portion of the helmet. The crown pad has multiple spaced-apart cells.

Protection of the crown portion is also important, as players often lower their heads when running from base to base. At the same time, the ball is typically thrown in the direction of the base. In some situations, players slide face-forward in the direction of a base while the ball is thrown in the direction of the base.

The wrap around pad includes multiple cells spaced along a curved line around the concave curvature of the helmet. It includes, as well, at least one additional cell at each end of the curved line and located above or below the curved line. The cells may be of any shape, including circular and polygonal.

Each cell of each pad has an outer sheet of thermoplastic welded around a perimeter of the outer sheet to the perimeter of an inner sheet of thermoplastic. Each inner sheet is designed to engage the head of a player wearing the helmet and defines one enclosure for each cell.

A foam cushion substantially fills each enclosure of each cell.

The outer sheet of each cell defines multiple spaced-apart, outwardly projecting hollow protrusions contacting the concave curvature of the helmet shell. Each protrusion has a open large diameter base adjacent to an outer surface of the foam cushion. Each protrusion has, as well, a smaller diameter flat peak engaging the concave curvature of the helmet and a conical side wall that tapers from the base to the peak.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 is a top plan view of the crown pad, showing the inner surface of the pad;

FIG. 7A is an edge view of the crown pad;

FIG. 8 is a top plan view of the crown pad, showing the outer surface of the pad with one half of a hook-and-loop fastener;

FIG. 12 is a cross-sectional view of the wrap-around pad, taken along line 12-12 of FIG. 9;

FIG. 13 is a cross-sectional view of the wrap-around pad, taken along line 13-13;

FIG. 14 is a top plan view of the inner surface of the jaw pad;

FIG. 14A is a cross-sectional view of the jaw pad; and

FIG. 15 is a top plan view of the inner surface of the jaw pad.

DESCRIPTION OF THE PREFERRED EMBODIMENTS

Figure 1:
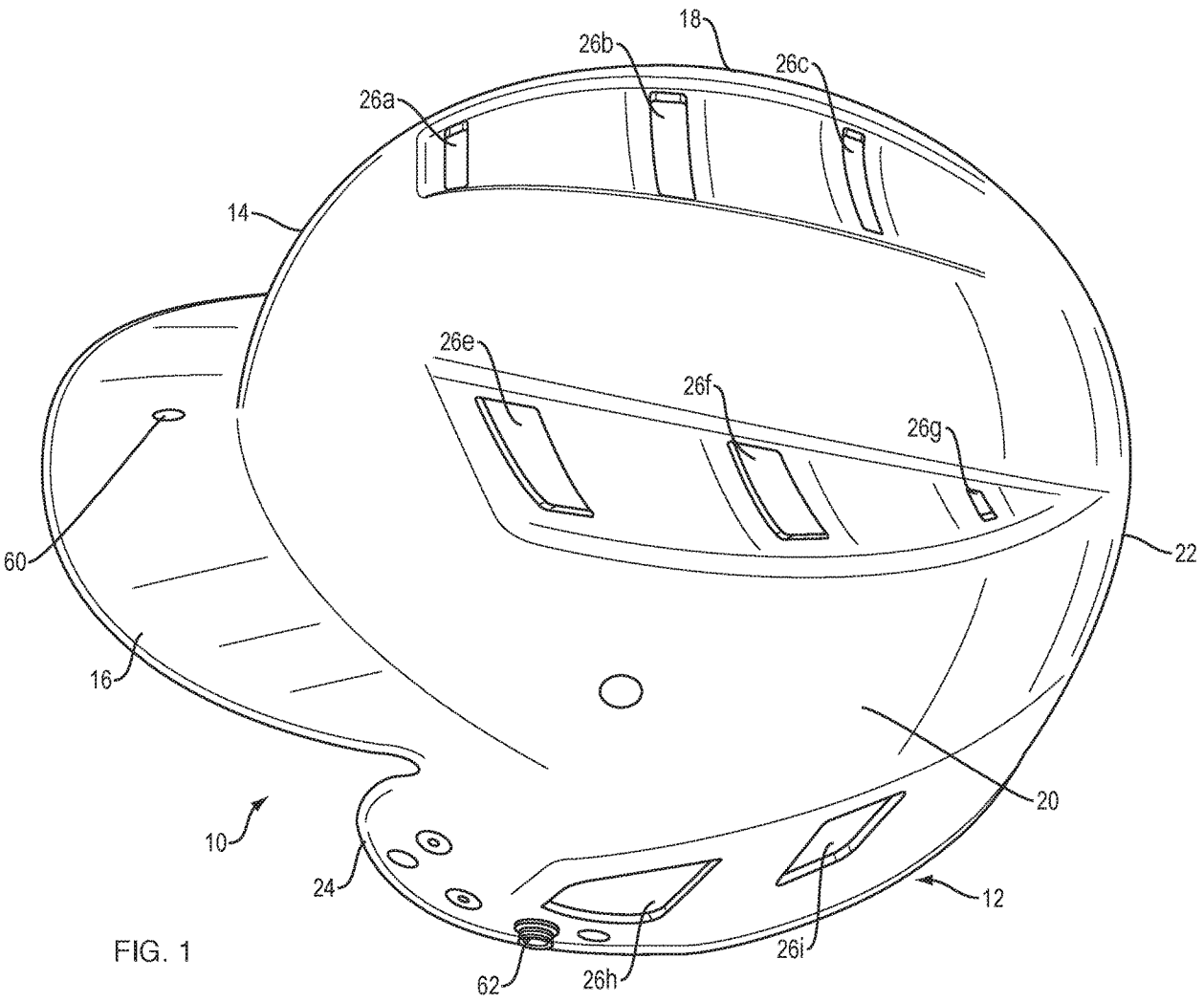
FIG. 1 is a top perspective view of a batting helmet according to the present invention.

Referring now to the drawings, in which like reference numerals are used to refer to the same or similar elements, FIGS. 1-6 show a batting helmet arrangement 10 comprising a rigid shell 12 adapted to cover the head of a wearer. The rigid shell 12 has an outer surface and an inner surface, the inner surface having selected concave curvatures at various portions of the shell as can be better appreciated from FIGS. 5 and 6. Returning to FIG. 1, the shell 12 has a front portion 14 for covering at least part of the forehead of the wearer, the front portion 14 having a visor part 16 extending therefrom, the visor part 16 having a slightly concave curvature, a crown portion 18 for covering the top of the wearer's head, a pair of opposite side portions 20 for covering the sides of the wearer's head, a back portion 22 for covering the back of the wearer's head, as well as a pair of opposite jaw flaps 24.

The helmet shell 12 has several openings 26, both for providing ventilation, and for reducing the overall weight of the helmet system 10. It is within the scope of the invention for the openings 26 to be of any shape, including, but not limited to polygonal or round. The openings may be unitary or grouped. In one embodiment, the helmet shell 12 has five groupings of openings 26*a* to 26*i*.

Figure 2:
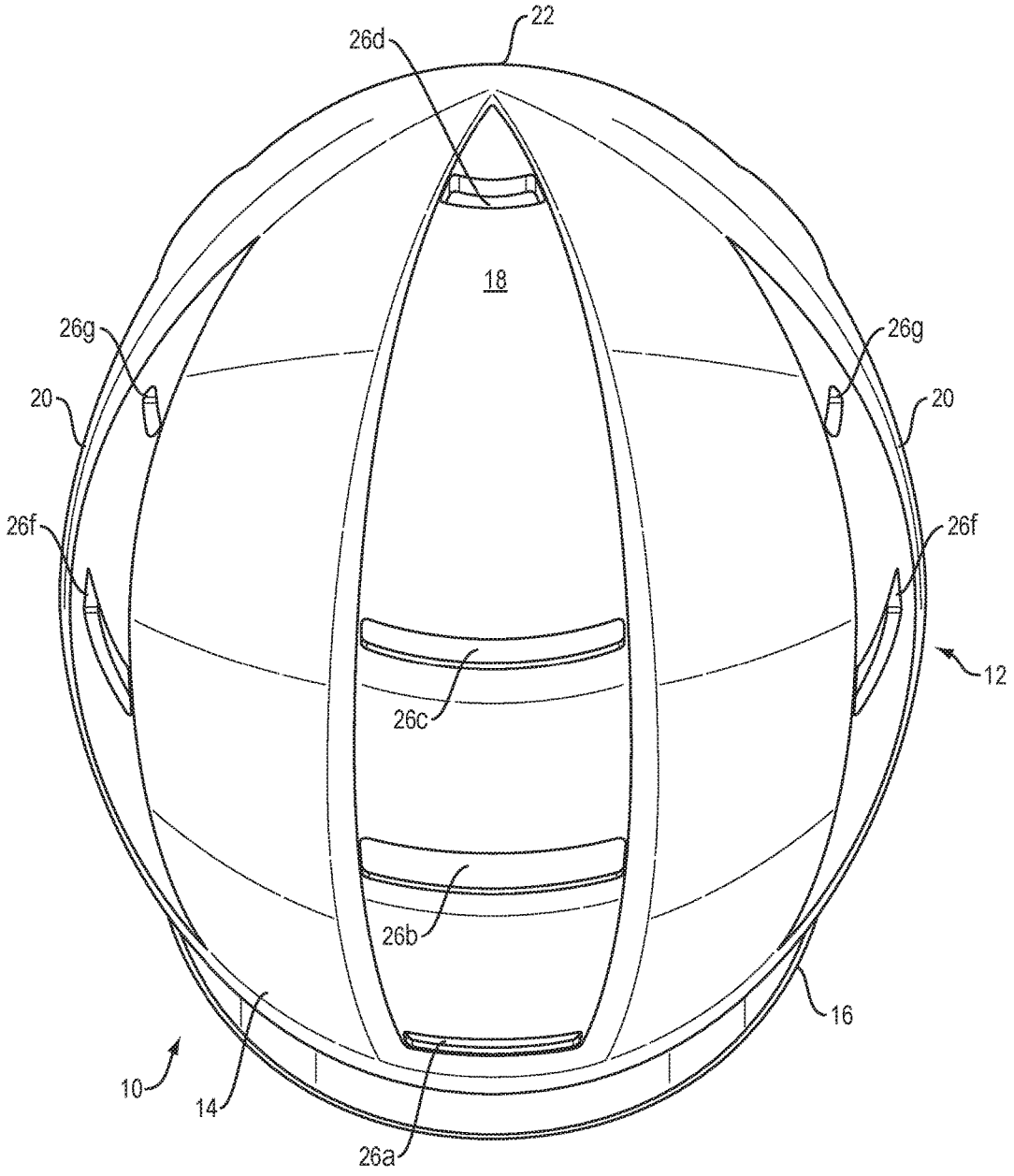
FIG. 2 is a top plan view of the batting helmet.
Figure 3:
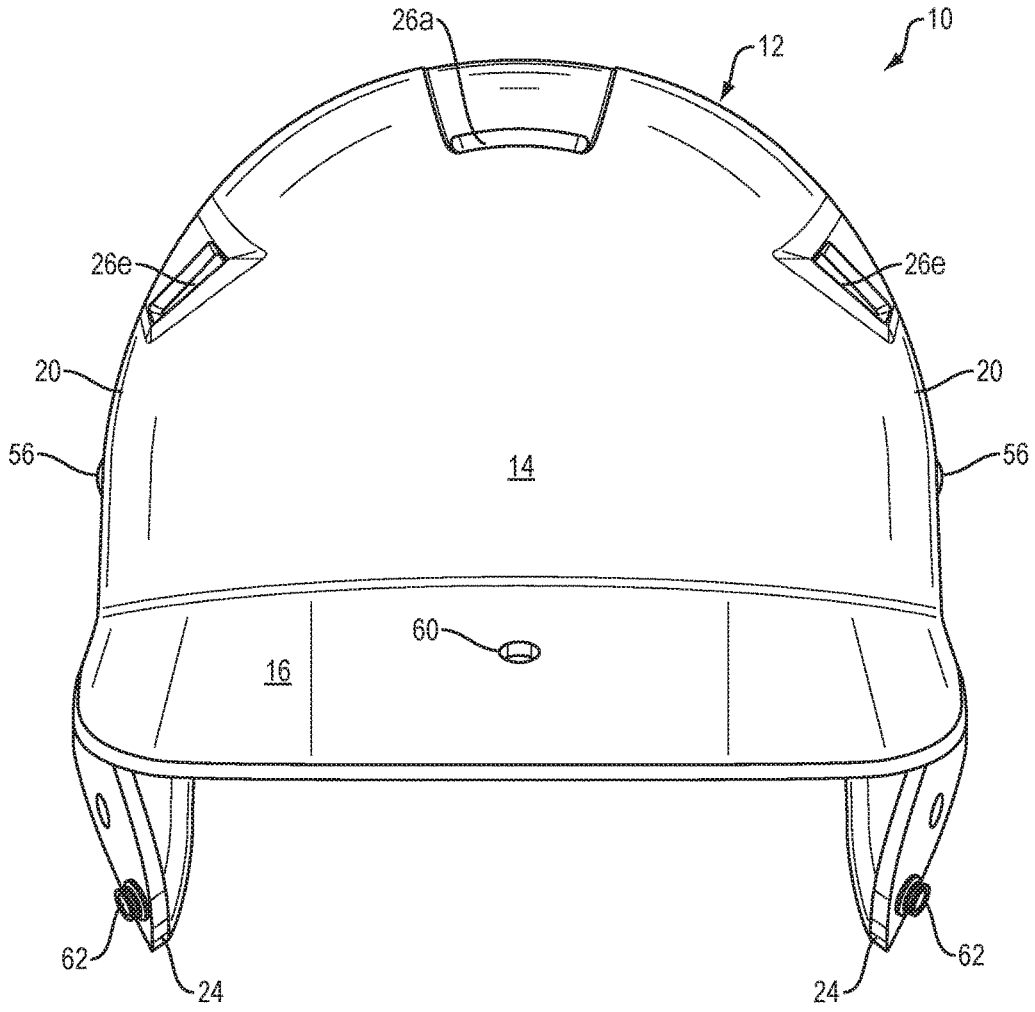
FIG. 3 is a front elevational view of the helmet.
Figure 4:
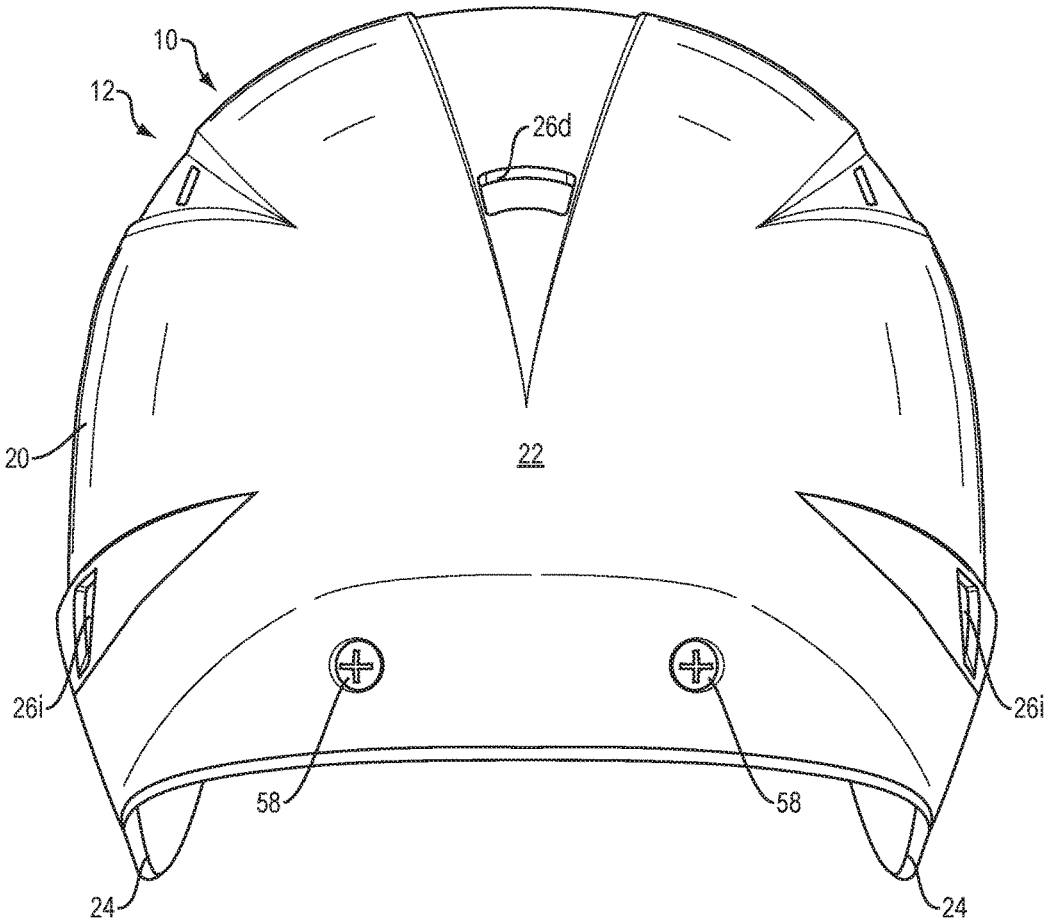
FIG. 4 is a back elevational view of the helmet.

As best seen in FIG. 1, the shell has identical, lateral groupings of three openings 26*e* to 26*g* on either side of the helmet shell 12, being located in the respective regions between the crown portion 18 and the side portions 20. In these groupings, the opening 26*e* closest to the front portion 14 has the largest area, the middle opening 26*f* has a smaller area, and the back opening 26*g* has the smallest area As best seen in FIG. 2, the next grouping is along the crown portion 18 of the shell, and is made up of four substantially rectangular openings 26*a* to 26*d*. In this first grouping, the opening 26*a* located closest to the front portion 14 of the helmet shell 12 and the opening 26*d* located near back portion 22 of the helmet shell 12 have smaller areas relative to the middle openings 26*b*, 24*c*.

Figure 5:
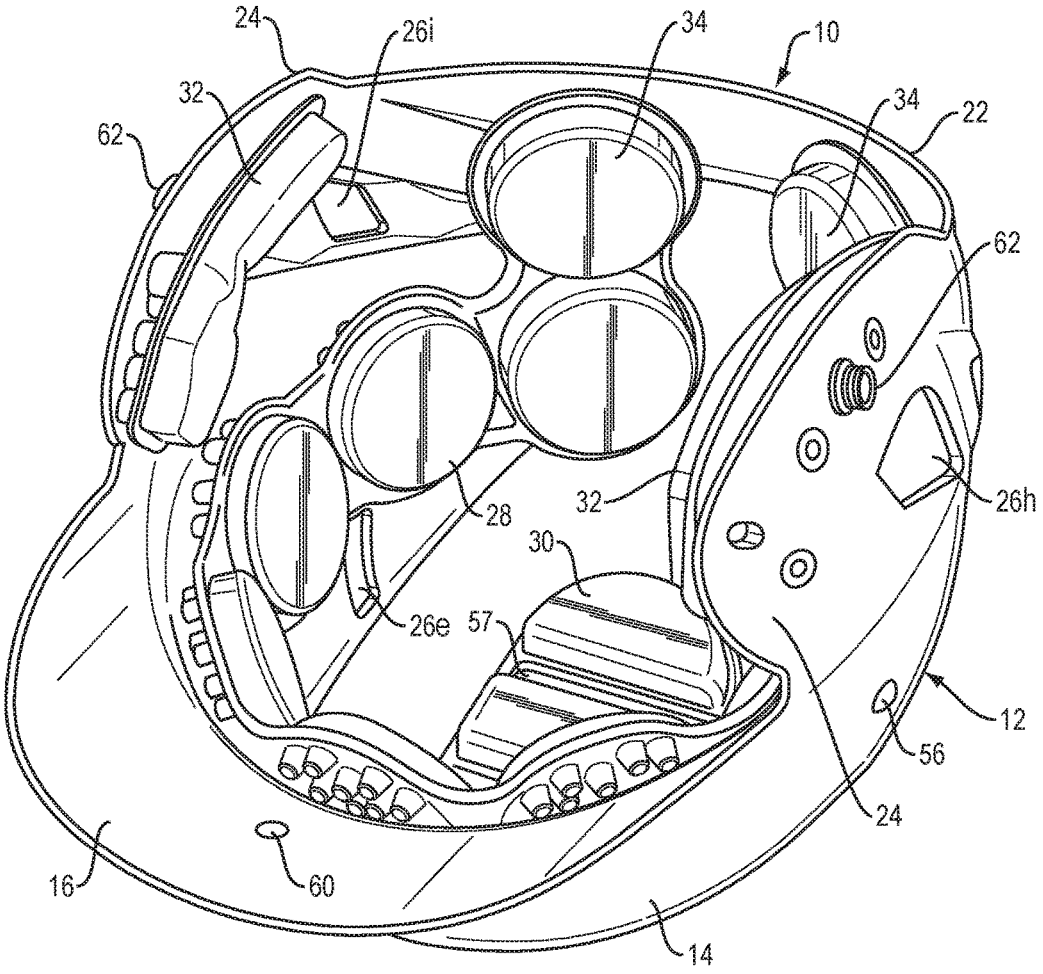
FIG. 5 is a bottom perspective view of the helmet, showing the jaw pads, the wrap-around pads and the crown pads in their typical orientation inside the helmet.

Finally, as can best be seen at FIGS. 1 and 5, the helmet shell 12 has identical openings 26*h* located in the respective the jaw flaps 24. Behind each of these jaw flap openings 26*h* is a smaller opening 26*i*, which is slightly higher up on the helmet shell 12.

Figure 6:
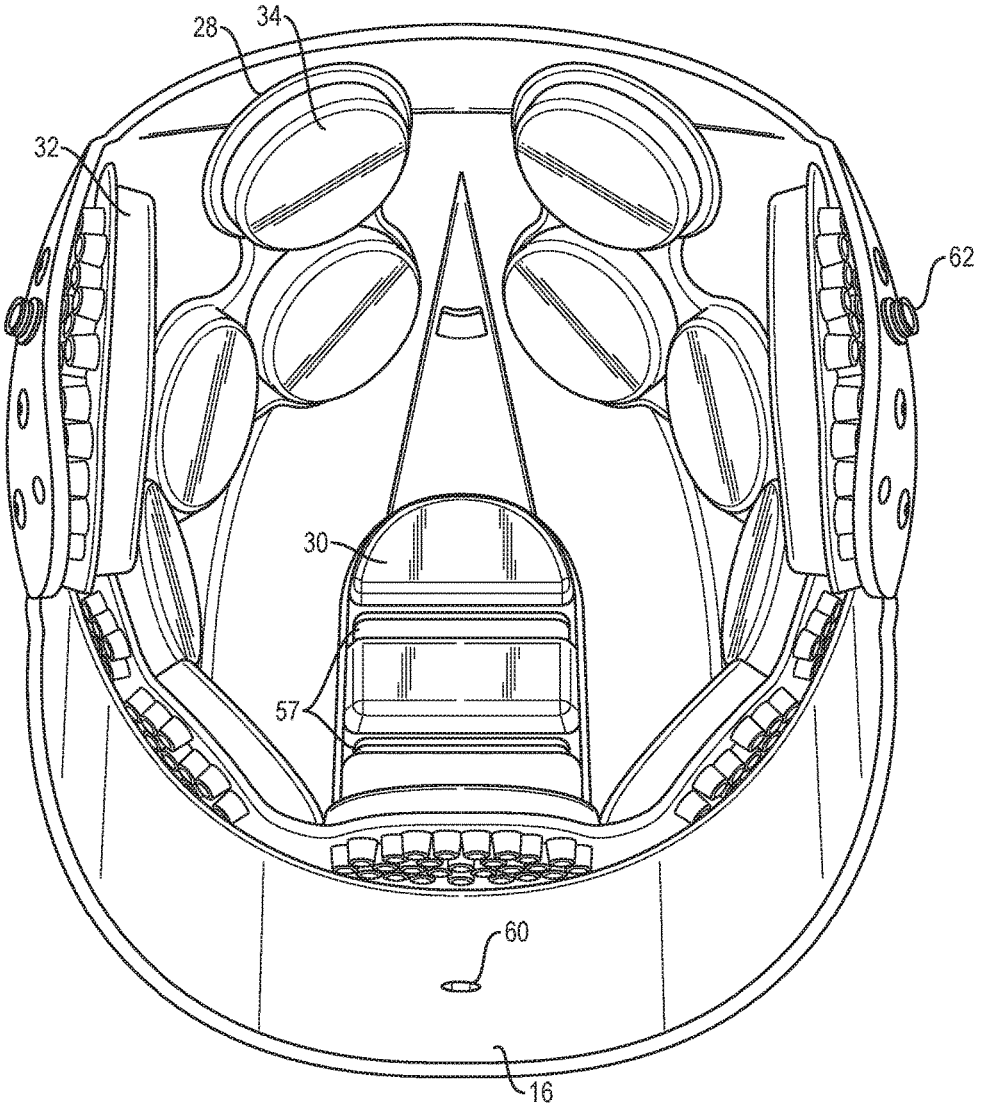
FIG. 6 is a bottom plan view, showing the jaw pads, the wrap-around pads and the crown pads in their typical orientation inside the helmet.

As shown in FIGS. 5 and 6, a comfort liner system is attached to the inner surface of the rigid shell 12 and comprises a plurality of impact absorbing pads that are spaced apart on the inner surface of the shell 12 and that conform to the inner concave curvatures at the various portions of the shell.

The padding system comprises a wrap-around pad 28 engaged to the front, side and rear portions of the inside of the shell 12, a crown pad 30 removably engaged to the top, inside of the shell 12 and two jaw pads 32, each attached to one of the jaw flaps 24 on the inner surface of the shell 12. The pads 28, 30, 32 may be permanently or removably attached to the inner surface of the shell 12.

Figure 9:
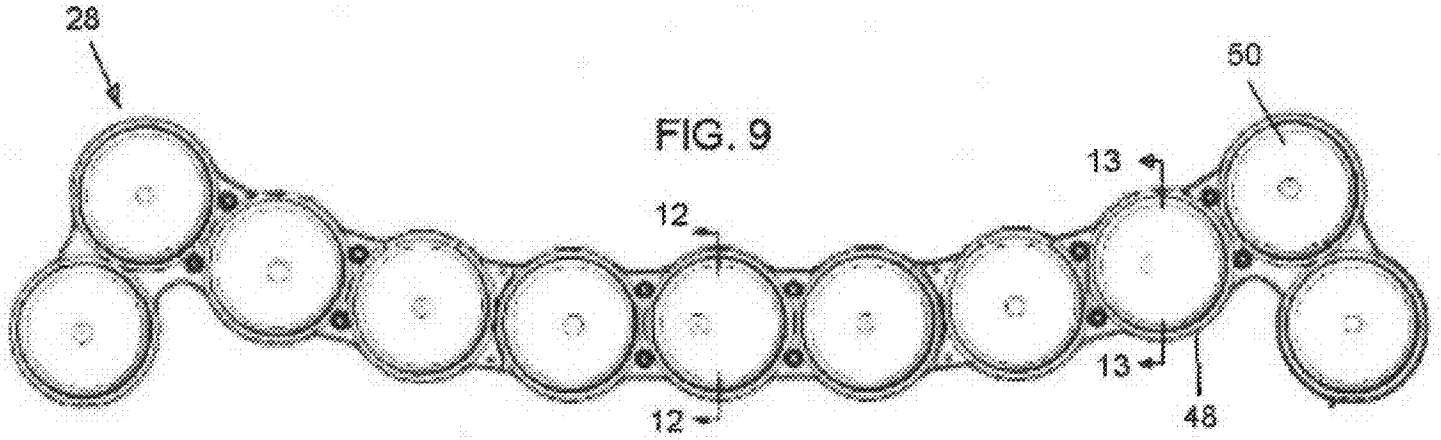
FIG. 9 is a top plan view of the inner surface of the wrap-around pad, laid out.
Figure 10:
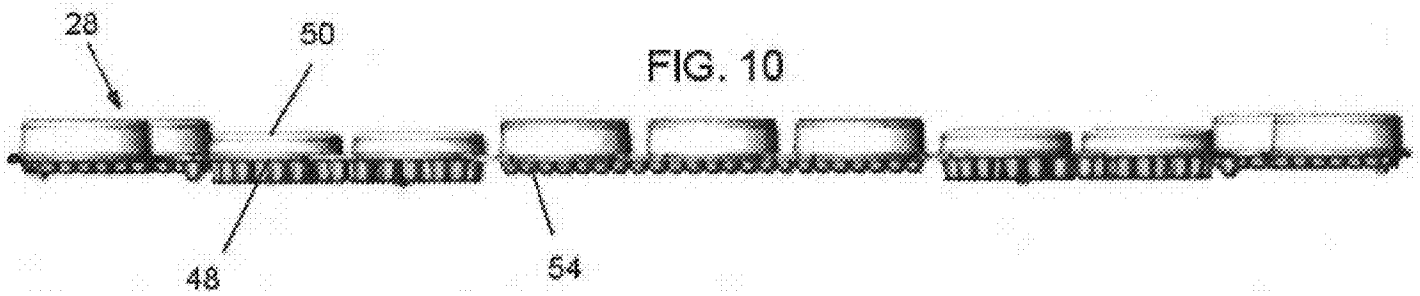
FIG. 10 is an edge view of the wrap-around pad, showing both the inner and outer surfaces of the pad.
Figure 11:
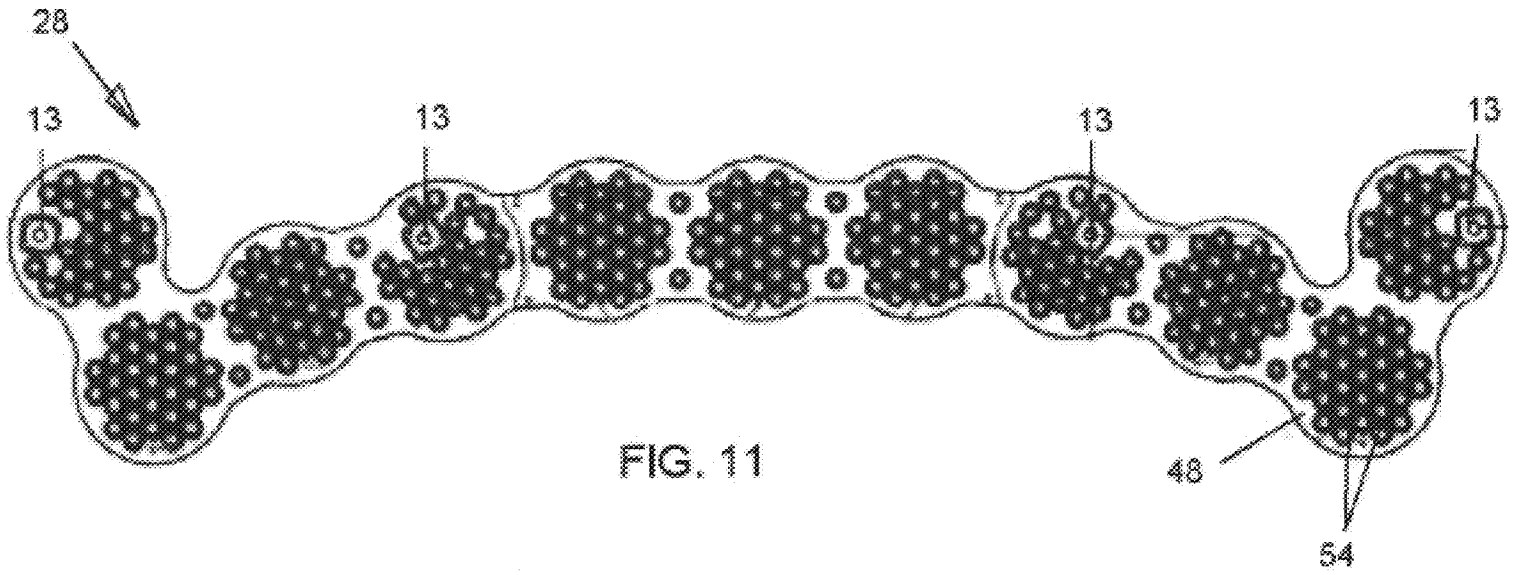
FIG. 11 is a top plan view of the outer surface of the wrap-around pad, laid out

FIGS. 9-11 show the wrap-around pad 28 which includes a group of substantially circular cells 34 spaced along a curved line around the inner curvature of the shell 12. The number of cells which make up the wrap-around pad 28 may vary within the scope of the present invention. In certain embodiments, such as the one shown in FIGS. 9-11, there are 9 circular cells along the curved line. It is within the scope of the invention for the wrap-around pad 28 to have different numbers of cells, as well. It is within the scope of the present invention, for example, for the wrap-around pad to have 5-15 cells. It is also within the scope of the present invention for the wrap-around pad to have 7-13 cells. The wrap-around pad 28 includes at least one additional cell 34 at each end of the curved line, located off the curved line. In certain embodiments, the additional cell 34 is above the curved line. In certain other embodiments, the additional cell 34 is below the curved line. While the cells 34 are circular in the embodiment shown, the cells 34 may be of any convenient or effective shape and remain within the scope of the present invention. The cells of the wrap-around pad may have a range of sizes within the scope of the present invention. In certain embodiments, the cells have a diameter in the range of 1.5-2.5 inches.

As shown in FIGS. 5 and 6, the crown pad 30 is engaged to the crown portion 18 of the inside of the helmet. FIGS. 7, 7A, and 8 illustrate that the crown pad 30 includes three cells 40, 42, 44. FIGS. 6 and 7 shows that the slots 57 of the crown pad line up with the apertures 26*b* and 26*c* of the helmet 12. In other embodiments, the crown pad has additional cells and slots, for example 4 cells and 3 slots that line up with, apertures 26*a*, 26*b* and 26*c* of the helmet 12.

FIGS. 14 and 15 show that each of the jaw pads 32 is made up of one L-shaped cell. As shown in FIG. 15, the jaw pads 32 may be connected to the jaw flaps by snaps 46.

As shown in FIGS. 9-13, each cell of each pad 28, 30, 32 includes an outer sheet 48 of thermoplastic welded around its perimeter to the perimeter of a second, inner sheet 50 of thermoplastic. Each inner sheet 50 is designed to engage the head of a player wearing the helmet 10 and defines one enclosure for each cell. As best seen in FIGS. 13 and 14, each cell contains a foam cushion 52.

Further, the outer sheet 48 of each cell defines multiple spaced apart, outwardly projecting hollow protrusions 54 contacting the inside of the shell 12. Each protrusion 54 has an open, large diameter base near the foam cushion 52 and a smaller diameter flat peak engaging the inside of the helmet. Each protrusion 54 also has a conical side wall that tapers from the base to the peak.

According to the invention, at least some of the pads of the padding system are removably attached to the inside surface of shell by mechanical fasteners extending through the shell 12, such as snaps, hook-and-loop fasteners 55 (shown in FIG. 8) or T-nuts 13 (shown in FIGS. 9-11) having a flange nut with a threaded tube for engaging a hole in the pad and for extending through a hole in the shell, and a treaded screw, treaded to the threaded tube. As can be seen in FIGS. 1 and 3-6, the helmet shell has one screw 56 in each of the side portions 20 and two screws 58 in the back portion of the helmet. These screws are for permanently securing the wrap-around pad 28 to the helmet shell 12 by means of the T-nuts. The wrap-around pad 28 has apertures therethrough along the outer sheet 48 adapted to receive an end of the T-nut opposite the side of the T-nut which is secured directly to the helmet shell 12.

The helmet shell 12 also has apertures 60 in the visor 16 and the jaw flaps 24 adapted to facilitate the optional addition of a face guard to the helmet 12.

Each jaw flap 24 also has a snap attachment 62 for securing an optional chin strap to the helmet.

While specific embodiments of the invention have been shown and described in detail to illustrate the application of the principles of the invention, it will be understood that the invention may be embodied otherwise without departing from such principles.

What is claimed is:

1. A liner assembly for a protective helmet comprising:

a wrap-around pad adapted to be engaged to an inner surface of the helmet, the wrap-around pad having a plurality of circular cells spaced along a curved line configured to be around the inner surface, and at least one additional cell at each end of the curved line, the wrap-around pad also having one additional cell at each end of the curved line;

a crown pad removably engageable to a crown portion of the inner surface; and two jaw pads, each jaw pad removably engageable to a respective jaw flap of the helmet, and each jaw pad comprising one cell having two curvilinear segments, the curvilinear segments meeting one another at an angle;

wherein each cell of each of said pads includes an outer sheet of thermoplastic welded around a perimeter of the outer sheet to a perimeter of a second, inner sheet of thermoplastic, each inner sheet being adapted to engage the head of a player when the player is wearing the helmet, and each inner sheet defining one enclosure for each cell;

wherein each cell of each of said pads contains a foam cushion; and wherein each cell of each of said pads defines multiple spaced apart, outwardly-projecting hollow protrusions adapted to contact the inner surface of the helmet, each of the protrusions having an open base near the foam cushion and having a flat peak adapted to engage the inner surface of the helmet, the base having a larger diameter relative to a diameter of the peak, and each of the protrusions also having a conical side wall that tapers from the base to the peak.

2. The liner assembly of claim 1, wherein the crown pad comprises 1-5 cells.

3. The liner assembly of claim 2, wherein the crown pad comprises 3 cells.

4. The liner assembly of claim 1, wherein there are 2-20 cells along the curved line.

5. The liner assembly of claim 4, wherein there are 5-15 cells along the curved line.

6. The liner assembly of claim 1, wherein there are 9 cells along the curved line.

7. The liner assembly of claim 1, wherein the at least one additional cell at each end of the curved line is located above the curved line.

8. The liner assembly of claim 1, wherein the at least one additional cell at each end of the curved line is located below the curved line.

9. A liner assembly for a protective helmet comprising:

a wrap-around pad adapted to be engaged with an inside of the helmet, the wrap-around pad having a plurality of circular cells spaced along a curved line configured to be around the inside of the helmet, the wrap-around pad having at least one additional cell at each end of the curved line and one additional cell at each end of the curved line;

a crown pad adapted to be removably engageable to a crown portion of the helmet; and two jaw pads, each jaw pad having two curvilinear segments, the curvilinear segments meeting one another at an angle, each jaw pad adapted to be removably engageable to a respective jaw flap of the helmet;

each cell includes an outer sheet of thermoplastic welded around a perimeter of the outer sheet to a perimeter of a second, inner sheet of thermoplastic;

each inner sheet configured to engage a player's head when the player is wearing the helmet, and each inner sheet defining one enclosure for each cell;

each cell containing a foam cushion and defining multiple spaced apart, outwardly-projecting hollow protrusions for contacting the inside of the helmet, each protrusion having an open base near the foam cushion and having a flat peak for engaging the inside of the helmet, the base having a larger diameter relative to a diameter of the peak, and each of the protrusions also having a conical side wall that tapers from the base to the peak.

10. The liner assembly of claim 9, wherein the crown pad comprises 1-5 cells.

11. The liner assembly of claim 10, wherein the crown pad comprises 3 cells.

12. The liner assembly of claim 9, wherein there are 2-20 cells along the curved line.

13. The liner assembly of claim 12, wherein there are 5-15 cells along the curved line.

14. The liner assembly of claim 9, wherein there are 9 cells along the curved line.

15. The liner assembly of claim 9, wherein the at least one additional cell at each end of the curved line is located above the curved line.

16. The liner assembly of claim 9, wherein the at least one additional cell at each end of the curved line is located below the curved line.

* * * * *